US010167747B2

(12) United States Patent
De Oliveira Ghiraldi et al.

(10) Patent No.: US 10,167,747 B2
(45) Date of Patent: Jan. 1, 2019

(54) SHEET METAL LOCKING COVER FOR A CAM PHASER

(71) Applicant: Schaeffler Technologies AG & Co. KG, Herzogenaurach (DE)

(72) Inventors: Renato De Oliveira Ghiraldi, Madison Heights, MI (US); Alexandre Camilo, Troy, MI (US)

(73) Assignee: SCHAEFFLER TECHNOLOGIES AG & CO. KG, Herzogenaurach (DE)

( * ) Notice: Subject to any disclaimer, the term of this patent is extended or adjusted under 35 U.S.C. 154(b) by 113 days.

(21) Appl. No.: 15/338,309

(22) Filed: Oct. 28, 2016

(65) Prior Publication Data

US 2018/0119581 A1 May 3, 2018

(51) Int. Cl.
*F01L 1/344* (2006.01)
*F01L 1/46* (2006.01)

(52) U.S. Cl.
CPC ..... *F01L 1/34403* (2013.01); *F01L 1/3442* (2013.01); *F01L 1/46* (2013.01); *F01L 2001/34469* (2013.01); *F01L 2001/34479* (2013.01); *F01L 2101/00* (2013.01); *F01L 2103/00* (2013.01)

(58) Field of Classification Search
CPC ... F01L 2001/34469; F01L 2001/34479; F01L 2103/00
USPC ..... 123/90.15, 90.17, 90.38
See application file for complete search history.

(56) References Cited

U.S. PATENT DOCUMENTS

| | | | | |
|---|---|---|---|---|
| 6,386,167 | B1 | 5/2002 | Urckfitz et al. | |
| 6,948,467 | B2 | 9/2005 | Lipke et al. | |
| 7,318,400 | B2 | 1/2008 | Lipke et al. | |
| 8,931,446 | B2 | 1/2015 | Wagner et al. | |
| 2005/0188933 | A1* | 9/2005 | Lipke | F01L 1/022 123/90.17 |
| 2007/0039576 | A1 | 2/2007 | McCarthy et al. | |
| 2007/0062474 | A1 | 3/2007 | Lipke et al. | |
| 2008/0289594 | A1 | 11/2008 | Kleiber | |
| 2010/0000480 | A1* | 1/2010 | Weber | B21D 53/20 123/90.17 |
| 2011/0314656 | A1 | 12/2011 | Weber et al. | |
| 2012/0174884 | A1* | 7/2012 | Shinomiya | F01L 1/3442 123/90.15 |

(Continued)

FOREIGN PATENT DOCUMENTS

WO 2015-113534 A1 8/2015

*Primary Examiner* — Jorge Leon, Jr.
(74) *Attorney, Agent, or Firm* — Volpe and Koenig, P.C.

(57) ABSTRACT

A cam phaser includes a stator, a rotor positioned in the stator, a cover plate positioned on a first side of the stator, a locking cover positioned on a second side of the stator, a locking pin assembly configured to selectively lock the rotor in a position relative to the stator, a plurality of aligned first openings which extend through the stator, the cover plate, and the locking cover, a plurality of fasteners respectively inserted in the plurality of aligned first openings, and a plurality of aligned central openings forming a throughbore. The locking cover has a body made from sheet metal having a first axial side, a second axial side, a plurality of the first openings extending from the first axial side to the second axial aide, and a second opening extending from the first axial side to the second axial side. The body has a web portion and a plurality of reinforcing portions which are thicker than the web portion.

18 Claims, 2 Drawing Sheets

(56) References Cited

U.S. PATENT DOCUMENTS

| | | | | |
|---|---|---|---|---|
| 2012/0285407 | A1* | 11/2012 | Watanabe | F01L 1/3442 123/90.17 |
| 2013/0047943 | A1* | 2/2013 | Weber | F01L 1/3442 123/90.15 |
| 2013/0186356 | A1* | 7/2013 | Schelter | F01L 1/46 123/90.15 |
| 2015/0013636 | A1* | 1/2015 | Boese | F01L 1/3442 123/198 E |
| 2016/0273417 | A1* | 9/2016 | Watanabe | F01L 1/3442 |
| 2017/0370253 | A1* | 12/2017 | Watanabe | F01L 1/3442 |

* cited by examiner

SHEET METAL LOCKING COVER FOR A CAM PHASER

FIELD OF INVENTION

The present invention relates to a cam phaser, and, more particularly, to a sheet metal locking cover for a cam phaser.

BACKGROUND

Cam phasers are known devices which are used in engines to vary valve timing. Many cam phasers, such as vane-type cam phasers, include locking covers which are attached outside of the moving components of the phaser. The locking cover may act as a stationary component which helps to hold a rotor in a stator and facilitates locking of a locking pin.

FIGS. 3A and 3B illustrate an example of a prior art locking cover 100 which may be used in conjunction with a cam phaser. The locking cover 100 is ring-shaped, including a body 102 of uniform thickness having a center bore 104 extending therethrough. The locking cover 100 further includes a plurality of through holes 106 which receive fasteners for holding the locking cover 100 to a stator of the cam phaser (not shown). The locking cover 100 further includes a second through hole 108 which receives a bushing 110. The bushing 110 is cup-shaped in order to form a space 112 for receiving a locking pin therein.

Current manufacturing methods that are typically employed to form the locking cover 100 include molding using powdered metal and fine blanking. However these processes use a relatively large amount of raw material to produce the locking cover 100. In turn, cam phasers that utilize the known locking cover 100 are large, heavy, and have a high manufacturing cost, in part due to the locking cover construction. Attempting to address some of these issues by simply resizing the uniform thickness of the locking cover 100 is not a suitable solution as this would reduce its strength and render the locking cover 100 more susceptible to cracking or other types of deformation. Moreover, a uniformly thinner locking cover would not match the thickness of existing bushings 110.

The present disclosure is directed to overcoming one or more problems of the prior art.

SUMMARY

In one aspect, the present disclosure is directed to a cam phaser. The cam phaser includes a stator, a rotor positioned in the stator, a cover plate positioned on a first side of the stator, a locking cover positioned on a second side of the stator, a locking pin assembly configured to selectively lock the rotor in a position relative to the stator, a plurality of aligned first openings which extend through the stator, the cover plate, and the locking cover, a plurality of fasteners respectively inserted in the plurality of aligned first openings, and a plurality of aligned central openings forming a throughbore. The locking cover includes a body formed from sheet metal having, a first axial side, a second axial side, a plurality of the first openings extending from the first axial side to the second axial aide, and a second opening extending from the first axial side to the second axial side. The body includes a web portion and a plurality of reinforcing portions which are thicker than the web portion.

In another aspect, the present disclosure is directed to a method of manufacturing a cam phaser. The cam phaser includes a stator, a rotor, a cover plate, a locking cover, a locking pin assembly, and a plurality of fasteners. The method includes deep drawing a sheet metal blank to produce the locking cover which includes a body comprising web portion and a plurality of reinforcing portions which are thicker than the web portion, and stamping the blank to produce a plurality of first openings, a central opening, and a second opening. The method also includes assembling the cam phaser, including positioning the bushing in the second opening, positioning the locking cover adjacent to the stator, and inserting the plurality of fasteners through aligned openings in the cover plate, stator, and locking cover, the aligned openings including the plurality of first openings.

BRIEF DESCRIPTION OF THE DRAWING(S)

The foregoing summary and the following detailed description will be better understood when read in conjunction with the appended drawings, which illustrate a preferred embodiment of the invention. In the drawings.

DETAILED DESCRIPTION OF THE PREFERRED EMBODIMENT(S)

Figure 1:
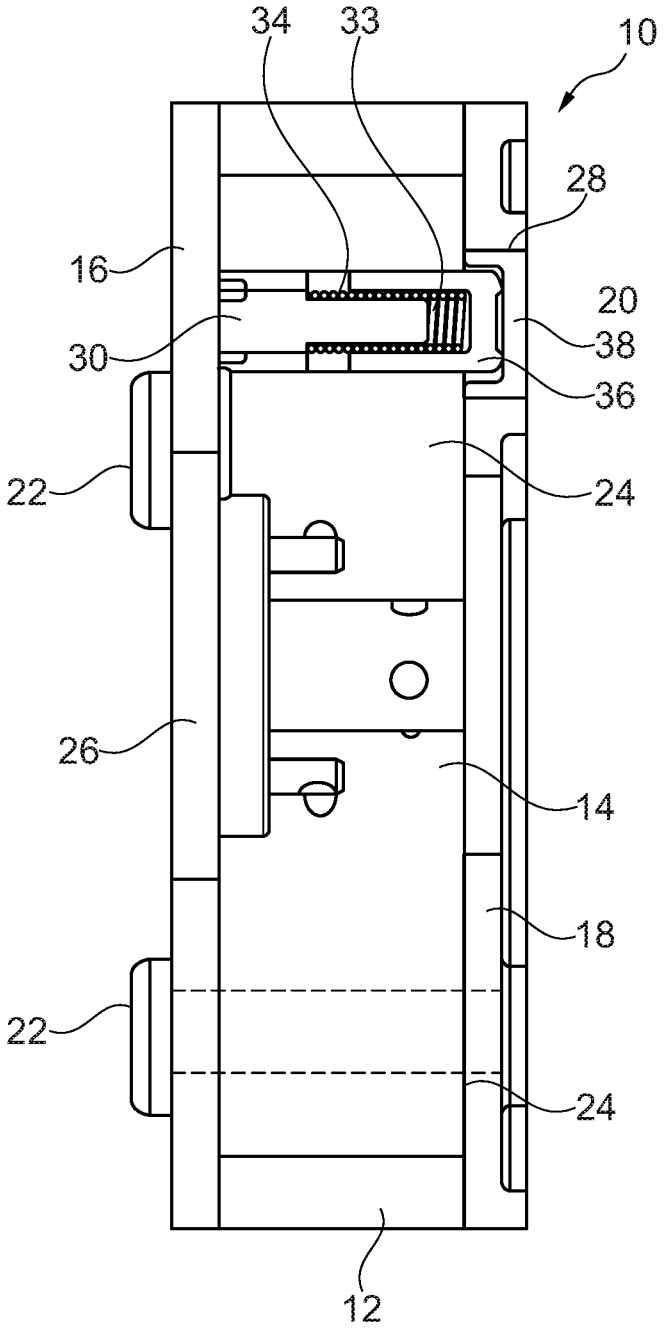
FIG. 1 is a cross-sectional view of a cam phaser which includes a locking cover according to an embodiment of the present invention.

FIG. 1 illustrates an exemplary cam phaser 10. The cam phaser 10 is preferably used in conjunction with an engine, such as an internal combustion engine, in order to vary valve timing in a manner known in the art (e.g., through hydraulic pressure). For example, the cam phaser 10 may be a vane-cell type cam phaser. The cam phaser 10 preferably includes at least a stator 12, a rotor 14, a cover plate 16, a locking cover 18, a locking pin assembly 20, and a plurality of fasteners 22. The cam phaser 10 may include additional components not described here, depending on the application. For example, some configurations may include components such as a solenoid, a torsional spring, housing parts, cam parts, a shaft, etc.

The rotor 14 is positioned in the stator 12 and rotates therein (e.g., through hydraulic pressure) in order to vary a valve timing in a manner known in the art. For example a plurality of hydraulic chambers (not shown) may be formed between vanes of the stator 12 and rotor 14, with changing hydraulic pressures in the hydraulic chambers causing movement of the rotor 14 within the stator 12. The cover plate 16 is positioned on one side of the stator 12 and rotor 14, and the locking cover 18 is positioned on the opposite side of the stator 12 and the rotor 14. The stator 12, cover plate 16, and locking cover 18 preferably each include a plurality of first openings 24 for receiving a fastener 22 (e.g., bolt) when respectively aligned with each other. The rotor 14, cover plate 16, and locking cover 18 preferably each include a central opening 26. The locking cover 18 includes a second opening 28 for receiving a portion of the locking pin assembly 20, as will be described in further detail below.

The locking pin assembly 20 includes a pin 30, a spring 33, a movable locking part 36, and a bushing 38. The pin 30 is preferably attached to and movable with the rotor 14. The movable locking part 36 is positioned over an end of the pin 30 and is slidable on the pin 30 and biased into an extended position by the spring 33. Under certain conditions (e.g., hydraulic pressure above or below a threshold level, the movable locking part 36 is biased by the spring 33 into the bushing 38, which is cup shaped. Receipt of the movable locking part 36 in the bushing 38 locks the rotor 14 into a particular position relative to the stator 12, until the locking pin assembly 20 is unlocked by an increase in hydraulic pressure.

Figure 2A:
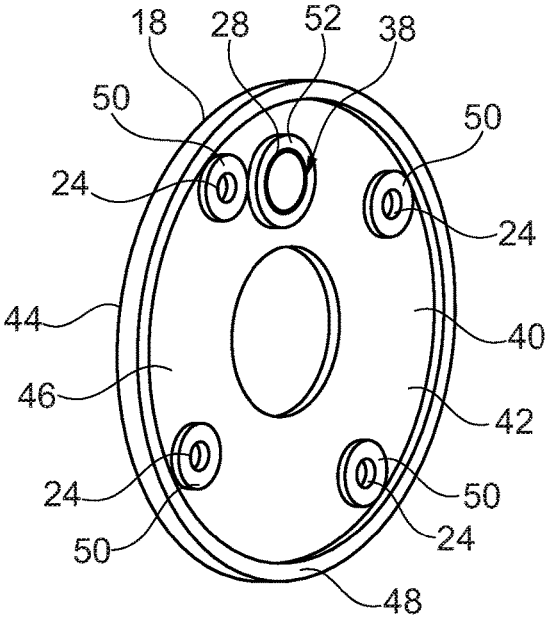
FIG. 2A is a perspective view of the locking cover of FIG. 1.
Figure 2B:
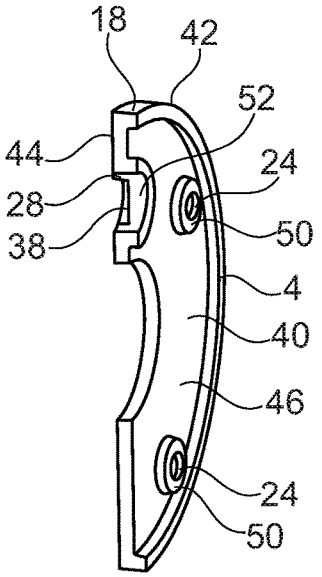
FIG. 2B is a cross-sectional view of the locking cover of FIG. 1.

FIGS. 2A-2B further illustrate the locking cover 18. The locking cover 18 includes a body 40 formed from sheet metal with a first axial side 42 and a second axial side 44. The first openings 24 are positioned around the body 40 and extend from the first axial side 42 to the second axial side 44. The central opening 26 of the locking cover 18 extends through a center of the body 40. The second opening 28 is formed at an appropriate location and extends from the first axial side 42 to the second axial side 44 and receives the bushing 38 therein.

Figure 3A:
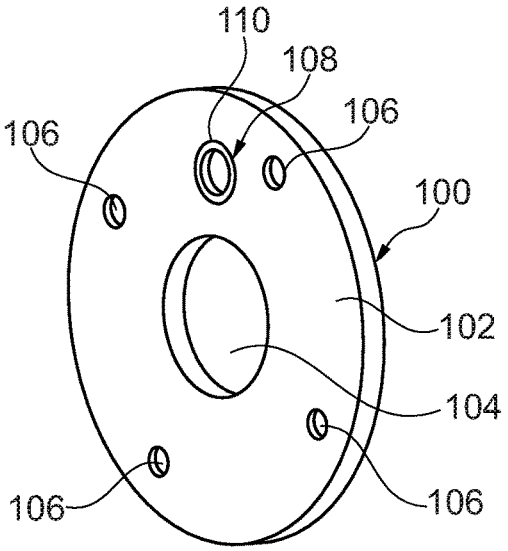
Fig. 3A PRIOR ART
FIG. 3A is a perspective view of a prior art locking cover.
Figure 3B:
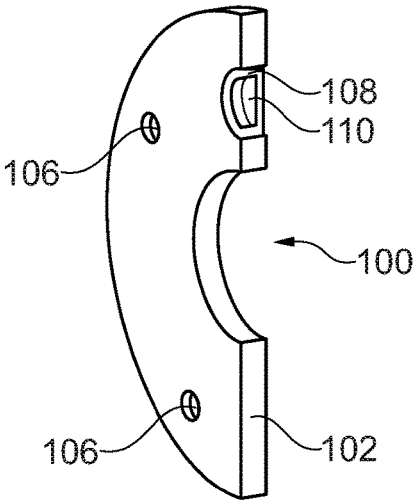
Fig. 3B PRIOR ART
FIG. 3B is a cross-sectional view of the locking cover of FIG. 3A.

The locking cover 18 is formed of sheet metal and is thinner than prior art locking plates, such as locking cover 100 of FIGS. 3A-3B, including a web portion 46. In order to provide additional strength and rigidity to the locking cover 18, some areas of the body 40 are thicker than the majority of the locking plate 100. These areas are referred to herein as reinforcing portions. For example, the locking cover 18 may include a rim 48 which extends around a perimeter of the body 40. In addition, the locking cover 18 may further include bosses 50, 52 which completely surround the first openings 24 and the second opening 28, respectively. These reinforcing portions provide increased rigidity to areas which may be most susceptible to deformation or cracking (e.g., at edges).

In the embodiment shown, the reinforcing portions are only provided on one side (e.g., the first axial side 42) of the locking cover 18. In this way, the second axial side 44 is flat over the entire side of the body 40 (i.e., planar) such that the locking cover 18 may be placed flat against the stator 12 and rotor 14 (see FIG. 1). In other embodiments, the reinforcing portions may be formed on both the first axial side 42 and the second axial side 44 or only the second axial side 44.

As shown in FIGS. 1 and 2B, the locking cover 18 and boss 52 may be sized to match a size of the bushing 38. In other words, when the bushing 38 is in the second opening 28, an open end of the bushing is flush with the body 40 on the second axial side 44 and a closed end of the bushing is flush with the body 40 (e.g., a rim of the boss 52) on the first axial side 42.

The exemplary disclosed locking cover 18 is preferably manufactured using a deep drawing and/or stamping process. In an exemplary disclosed process, a thin sheet metal blank is deep drawn to create the reinforcing portions (e.g., rim 48 and bosses 50, 52). A stamping step is also carried out to create the first openings 24, the central opening 26, and the second opening 28. This process produces the locking cover 18, which is substantially thinner than previous locking covers (e.g., locking cover 100), while maintaining a strength and rigidity necessary to withstand the forces associated with operation of the cam phaser 10.

In a further process, the locking cover 18 is assembled with the cam phaser 10. This process may include positioning the bushing 38 in the second opening 28, aligning the locking cover 18 with the rotor 14, and inserting the fasteners 22 through the first openings 24. During operation, the bushing 38 is positioned such that the movable locking part 36 is insertable into the bushing 38 to selectively lock the rotor 14 via the locking pin assembly 20.

The disclosed locking cover 18 thus provides a thinner component which uses less raw material (cost reduction), has less mass, takes up less space, and may be made through a more efficient process than previous locking covers.

Having thus described the presently preferred embodiments in detail, it is to be appreciated and will be apparent to those skilled in the art that many physical changes, only a few of which are exemplified in the detailed description of the invention, could be made without altering the inventive concepts and principles embodied therein. It is also to be appreciated that numerous embodiments incorporating only part of the preferred embodiment are possible which do not alter, with respect to those parts, the inventive concepts and principles embodied therein. The present embodiments and optional configurations are therefore to be considered in all respects as exemplary and/or illustrative and not restrictive, the scope of the invention being indicated by the appended claims rather than by the foregoing description, and all alternate embodiments and changes to this embodiment which come within the meaning and range of equivalency of said claims are therefore to be embraced therein.

PARTS LIST

10. Cam Phaser
12. Stator
14. Rotor
16. Cover Plate
18. Locking Cover
20. Locking Pin Assembly
22. Fastener
24. First Opening
26. Central Opening
28. Second Opening
30. Pin
32. Spring
34. Bearing
36. Movable Cover
38. Bushing
40. Body
42. First Axial Side
44. Second Axial Side
46. Web Portion
48. Rim
50. Boss
52. Boss
100. Locking Cover
102. Body
104. Throughbore
106. Through Hole
108. Second Through Hole
110. Bushing

What is claimed is:

1. A cam phaser, comprising
a stator;
a rotor positioned in the stator;
a cover plate positioned on a first side of the stator;
a locking cover positioned on a second side of the stator;
a locking pin assembly configured to selectively lock the rotor in a position relative to the stator;
a plurality of aligned first openings which extend through the stator, the cover plate, and the locking cover;
a plurality of fasteners respectively inserted in the plurality of aligned first openings; and a plurality of aligned central openings forming a through-bore, wherein the locking cover includes a body made of sheet metal having a first axial side, a second axial side, the plurality of first openings extending from the first axial side to the second axial aide, and a second opening extending from the first axial side to the second axial side that is adapted to receive at least a portion of the locking pin assembly, and a boss surrounds the second opening, and wherein the body includes a web portion and a plurality of reinforcing portions which are thicker than the web portion, and the plurality of reinforcing portions includes the boss which surrounds the second opening.

2. The cam phaser of claim 1, wherein the plurality of reinforcing portions include a rim which extends around a perimeter of the body.

3. The cam phaser of claim 1, wherein the plurality of reinforcing portions include a plurality of bosses which respectively surround the plurality of first openings in the locking cover.

4. The cam phaser of claim 1, wherein the locking pin assembly comprises a pin, a spring, a movable locking part, and a bushing, and the bushing is positioned in the second opening of the locking cover.

5. The cam phaser of claim 4, wherein the bushing includes an open end and a closed end, the closed end being flush with a rim of the boss on the first axial side and the open end being flush with the body on the second axial side.

6. The cam phaser of claim 4, wherein a thickness of the bushing from an open end to a closed end is greater than a thickness of the web portion.

7. The cam phaser of claim 6, wherein the thickness of the bushing is equal to a thickness of one of the plurality of reinforcing portions.

8. The cam phaser of claim 1, wherein the first axial side includes the plurality of reinforcing portions and the second axial side is planar.

9. The cam phaser of claim 8, wherein the second axial side is positioned flat against the stator.

10. A method of manufacturing a cam phaser which includes a stator, a rotor, a cover plate, a locking cover, a locking pin assembly, and a plurality of fasteners, the method comprising deep drawing a sheet metal blank to produce the locking cover which includes a body comprising a web portion and a plurality of reinforcing portions which are thicker than the web portion;

stamping the blank to produce a plurality of first openings, a central opening, and a second opening, the second opening adapted to receive at least a portion of the locking pin assembly, and the plurality of reinforcing portions includes a boss which surrounds the second opening; and assembling the cam phaser, comprising:

positioning a bushing and a movable locking part in the second opening, positioning the locking cover adjacent to the stator, and inserting a plurality of fasteners through aligned openings in the cover plate, stator, and locking cover, the aligned openings including the plurality of first openings.

11. The method of claim 10, wherein the plurality of reinforcing portions include a rim which extends around a perimeter of the body.

12. The method of claim 10, wherein the plurality of reinforcing portions include a plurality of bosses which respectively surround the plurality of first openings.

13. The method of claim 10, wherein the bushing includes an open end and a closed end, the closed end being flush with a rim of the boss on a first axial side and the open end being flush with the body on a second axial side.

14. The method of claim 10, wherein the locking cover includes a first axial side and a second axial side, wherein the first axial side includes the plurality of reinforcing portions and the second axial side is planar.

15. The method of claim 14, wherein the second axial side is positioned flat against the stator.

16. The method of claim 10, wherein a thickness of the bushing from an open end to a closed end is greater than a thickness of the web portion.

17. The method of claim 16, wherein the thickness of the bushing is equal to a thickness of one of the plurality of reinforcing portions.

18. A cam phaser, comprising a stator;

a rotor positioned in the stator;

a cover plate positioned on a first side of the stator;

a locking cover positioned on a second side of the stator;

a locking pin assembly configured to selectively lock the rotor in a position relative to the stator and including a pin, a spring, a movable locking part, and a bushing;

a plurality of aligned first openings which extend through the stator, the cover plate, and the locking cover;

a plurality of fasteners respectively inserted in the plurality of aligned first openings; and a plurality of aligned central openings forming a through-bore, wherein the locking cover includes a body made from sheet metal having a first axial side, a second axial side, the plurality of first openings extending from the first axial side to the second axial aide, and a second opening extending from the first axial side to the second axial side, wherein the body includes, on the first axial side, a web portion and a plurality of reinforcing portions which are thicker than the web portion, and the second axial side is planar, wherein the plurality of reinforcing portions include a rim which extends around a perimeter of the body and a plurality of bosses which respectively surround the plurality of first openings in the locking cover and the second opening, and wherein the bushing is positioned in the second opening, and wherein a thickness of the bushing is equal to a thickness of one of the plurality of reinforcing portions in an area of a boss that surrounds the second opening.

* * * * *